US012638228B2

(12) United States Patent
Archambault et al.

(10) Patent No.: US 12,638,228 B2
(45) Date of Patent: May 26, 2026

(54) REFRIGERATION SYSTEM FOR A CANNABIS PRODUCT MANUFACTURING MACHINE AND CANNABIS PRODUCT MANUFACTURING MACHINE THEREWITH

(71) Applicant: Le Groupe Solid Packaging Robotik Inc., Terrebonne (CA)

(72) Inventors: Robert Archambault, Boisbriand (CA); Daniel Martel, Terrebonne (CA); Harold Bouchard, Bois-des-Filion (CA)

(73) Assignee: Le Groupe Solid Packaging Robotik Inc., Terrebonne (CA)

( * ) Notice: Subject to any disclaimer, the term of this patent is extended or adjusted under 35 U.S.C. 154(b) by 301 days.

(21) Appl. No.: 18/060,686

(22) Filed: Dec. 1, 2022

(65) Prior Publication Data

US 2024/0183603 A1 Jun. 6, 2024

(51) Int. Cl.

| | |
|---|---|
| ***F25D 19/00*** | (2006.01) |
| ***A24B 15/16*** | (2020.01) |
| ***A24C 5/00*** | (2020.01) |

(52) U.S. Cl.
CPC ..... *F25D 19/006* (2013.01); *A24B 15/16* (2013.01); *A24C 5/00* (2013.01)

(58) Field of Classification Search
CPC ..... F25D 19/006; F25D 3/11; F25D 13/062; F25D 13/06; A24B 15/16; A24C 5/00
See application file for complete search history.

(56) References Cited

U.S. PATENT DOCUMENTS

| | | | | |
|---|---|---|---|---|
| 3,635,045 | A * | 1/1972 | Astrom | F25D 3/11 62/266 |
| 11,000,856 | B2 | 5/2021 | Pal et al. | |
| 11,291,699 | B1 * | 4/2022 | Benner | A61K 36/185 |
| 2022/0065514 | A1 * | 3/2022 | Shi | F25C 5/08 |

FOREIGN PATENT DOCUMENTS

| | | |
|---|---|---|
| EP | 23213163.1 | 5/2024 |

* cited by examiner

*Primary Examiner* — Elizabeth J Martin
(74) *Attorney, Agent, or Firm* — Agence de Brevets Fournier

(57) ABSTRACT

A refrigeration system for a *cannabis* product manufacturing machine provided with an intrant feeding system includes i) an enclosure for receiving at least part of the *cannabis* product manufacturing machine and having at least one opening for allowing access to the intrant feeding system and to *cannabis* products after production; and ii) a refrigeration system operatively mounted to the enclosure for forcing a first temperature in the enclosure. The refrigeration system can also be provided with a refrigeration subsystem coupled to the intrant feeding system for forcing a second temperature therein.

12 Claims, 4 Drawing Sheets

REFRIGERATION SYSTEM FOR A CANNABIS PRODUCT MANUFACTURING MACHINE AND CANNABIS PRODUCT MANUFACTURING MACHINE THEREWITH

FIELD

The present disclosure generally relates to *cannabis* products and more specifically to *cannabis* product manufacturing machines.

BACKGROUND

*Cannabis* joints have long been and are still very often prepared by hand.

However, the legalization of *cannabis* in many territories have seen the coming of the automatization in the manufacturing of *cannabis* joints.

*Cannabis* joints manufacturing systems are known in the art, which receives *cannabis* and *cannabis* cones as intrant, and which automatically or semi-automatically produce and output *cannabis* joints.

According to a new trend, the *cannabis* used for manufacturing joints is pre-mixed with CBD (cannabidiol), THC (Tetrahydrocannabinol), terpenes, *cannabis* resin or other component in oil form.

A problem with using such a mixture is that it is sticky at room temperature, such oil having a viscosity similar to that of molasses. Such a limited fluidity of the *cannabis*/oil mixture greatly limits its handling, and therefore its use in an automatic *cannabis* joints manufacturing machine.

SUMMARY

The problem of the limited fluidity of a *cannabis*-oil mixture in its use in an automatic *cannabis* joints manufacturing machine is solved by providing at least one processing station of the manufacturing machine in an enclosure that is refrigerated to lower the viscosity of the *cannabis*-oil mixture used therein.

The automatic *cannabis* joints manufacturing machine can also be provided with a *cannabis*-feeding system, to feed the *cannabis*-oil mixture to the processing stations, which is cooled to a temperature that is lower than the solidifying temperature of the oil.

According to an illustrative embodiment, there is provided a refrigeration system for a *cannabis* product manufacturing machine provided with an intrant feeding system comprising:

an enclosure for receiving at least part of the *cannabis* product manufacturing machine; the enclosure having at least one opening for allowing access to the intrant feeding system and to *cannabis* products after production; and a first refrigeration system operatively mounted to the enclosure for forcing a first temperature in the enclosure.

According to another illustrative embodiment, there is provided a machine for manufacturing *cannabis* products comprising:

a support;

a *cannabis* feeding system mounted to the support;

a products outlet mounted to the support;

at least one processing station between the *cannabis* feeding system and the products outlet for receiving *cannabis* in bulk from the *cannabis* feeding system, for using the *cannabis* in bulk to make *cannabis* products and for feeding the *cannabis* products to the products outlet;

a casing mounted to the support, which defines an enclosure with the support, for receiving therein the at least one processing station, at least part of the *cannabis* feeding system, at least part of the products outlet and at least part of the support; the enclosure having at least one opening for allowing access to the *cannabis* feeding system and to the *cannabis* products after production; and a first refrigeration system operatively mounted to the enclosure for forcing a first temperature in the enclosure.

According to still another illustrative embodiment, there is provided a *cannabis*-feeding system for a *cannabis*-product manufacturing machine comprising a refrigeration system for forcing a temperature in the *cannabis*-feeding system.

According to yet another illustrative embodiment, there is provided a process for manufacturing *cannabis* products comprising:

providing an oily mixture of *cannabis* in bulk at a first temperature; the oily mixture of *cannabis* including *cannabis* and an oil; the oil being characterized by a solidifying temperature, which is higher than the first temperature;

using the oily mixture of *cannabis* to create *cannabis* product in an enclosure that is characterized by having a second temperature therein which is higher than the first temperature and lower than 15° C.

Other objects, advantages, and features of the process and machine for manufacturing *cannabis* products and of the refrigeration system therefore will become more apparent upon reading the following non-restrictive description of illustrative embodiments thereof, given by way of example only with reference to the accompanying drawings.

DETAILED DESCRIPTION

Figure 1:
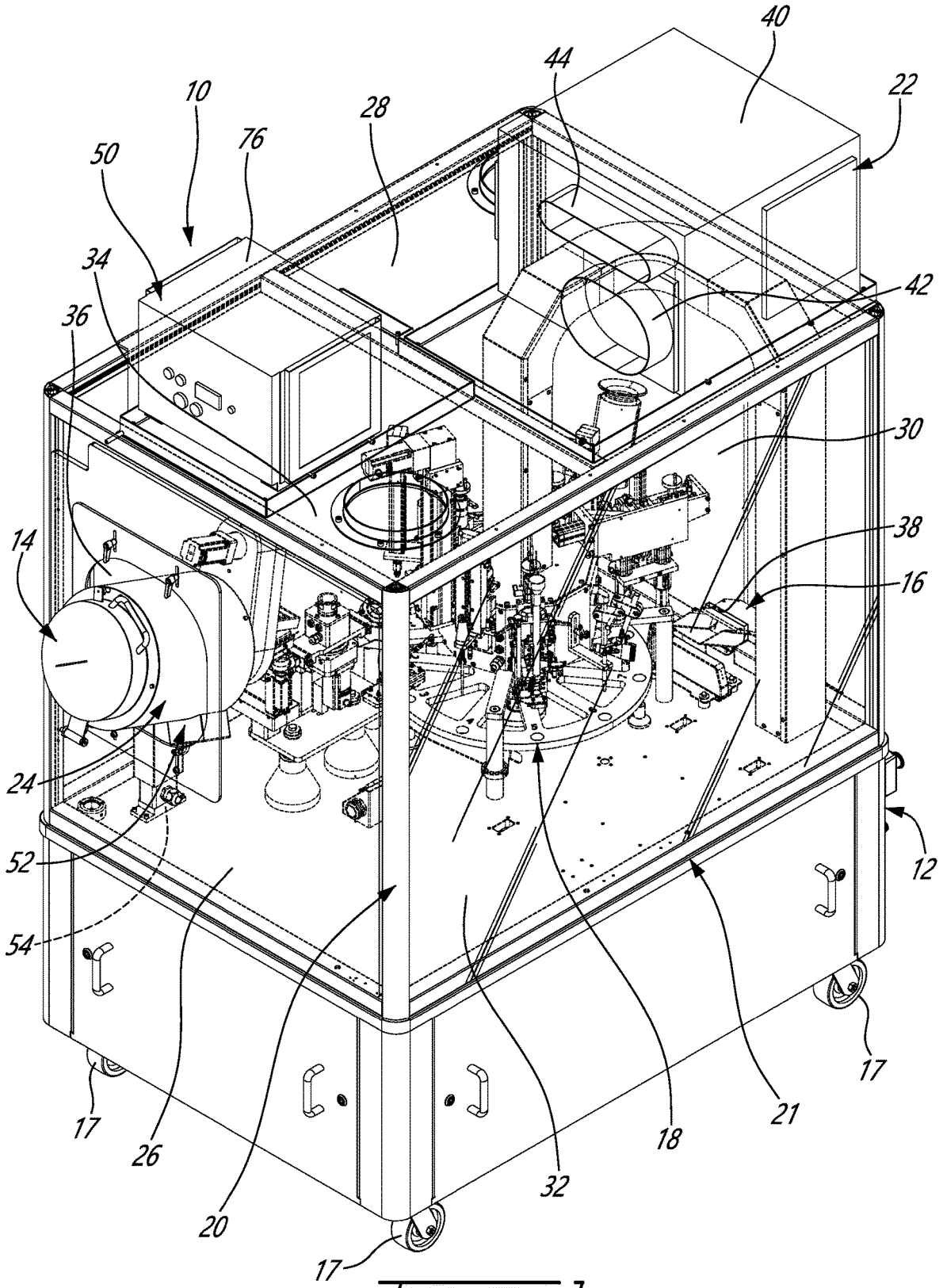
FIG. 1 is a perspective view of a *cannabis* products manufacturing machine according to an illustrative embodiment; the machine including a refrigeration system.
Figure 2:
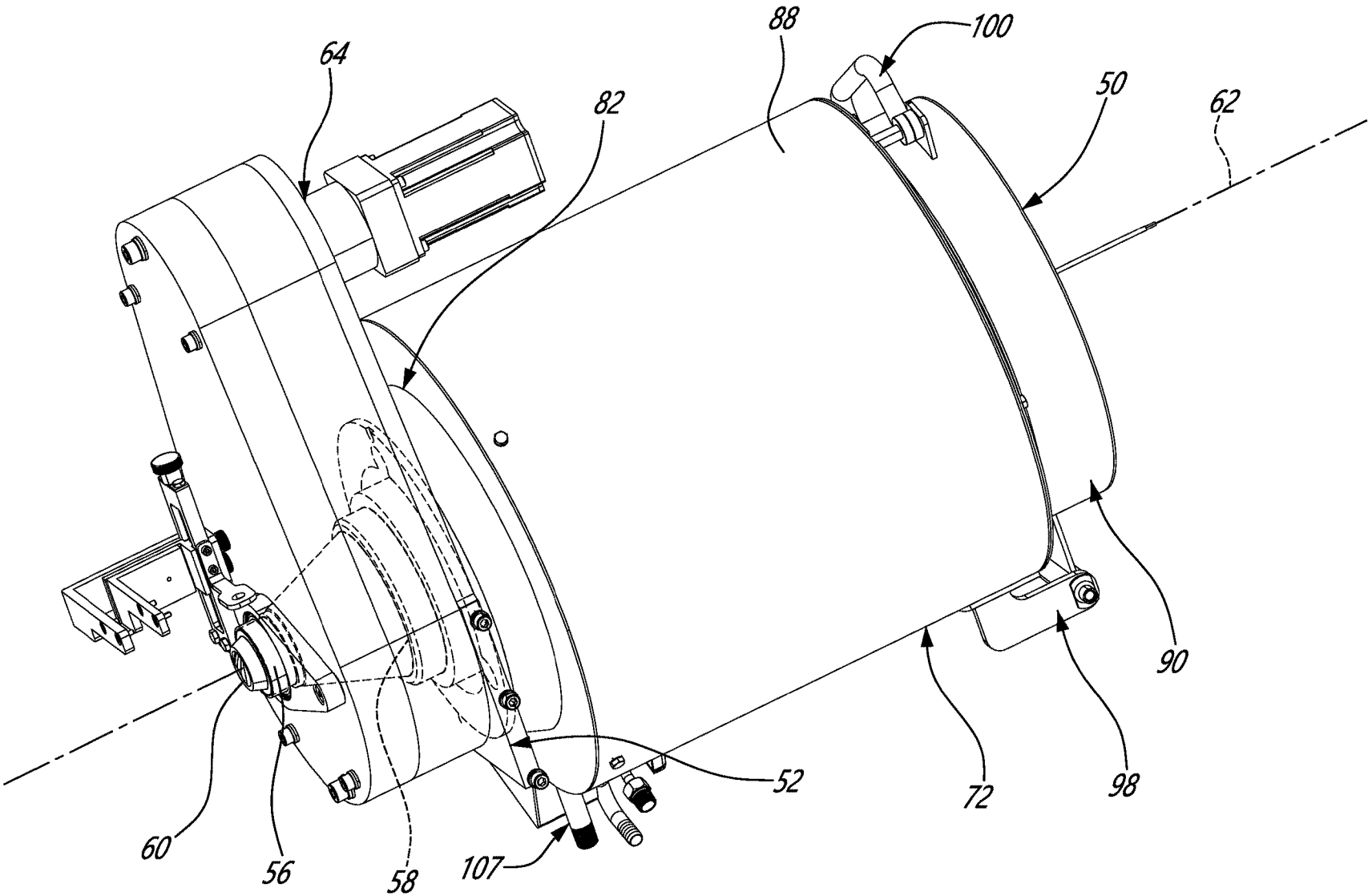
FIG. 2 is an isolated back perspective view showing part of the refrigeration subsystem of the refrigeration system from FIG. 1 that is dedicated to the *cannabis* feeding system.

In the following description, similar features in the drawings have been given similar reference numerals, and in order not to weigh down the figures, some elements are not referred to in some figures if they were already identified in a precedent figure. Herein, it shall further be noted that, for avoiding unnecessary details obscuring the invention, only device structures and/or processing steps closely relevant to schemes according to the invention are shown in the accompanying drawings while omitting other details less relevant to the invention.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, un-recited elements.

A machine 10 for manufacturing *cannabis* products according to an illustrative embodiment will now be described with reference first to FIG. 1.

The machine 10 allows manufacturing *cannabis* products in the form of *cannabis* joints (not shown), using *cannabis* in bulk and paper cones as inputs (both not shown). However, as will become more apparent upon reading the following description, the machine 10 can be adapted for manufacturing other *cannabis* products using as input *cannabis* in bulk or in another form with other intrants.

The machine 10 comprises a support, in the form of table 12, and, mounted to the table 12, i) a *cannabis* feeding system 14, ii) a products outlet 16, and processing stations 18 between the *cannabis* feeding system 14 and the products outlet 16 for receiving *cannabis* in bulk (not shown) from the *cannabis* feeding system 14, for using the *cannabis* in bulk to make *cannabis* products (not shown), and for feeding the *cannabis* products to the products outlet 16.

The machine 10 is made movable by providing the table 12 with wheels 17. According to another embodiment (not shown), the wheels 17 are omitted or replaced by other friction-reducing elements or system or by any such elements or system allowing easing movement of the table (not shown).

The machine 10 further comprising a transparent casing 20, mounted to the table 12, which defines an enclosure 21 with the table 12, and which receives therein the processing stations 18, part of the *cannabis* feeding system 14, and part of the products outlet 16.

Finally, the machine 10 also comprises a main refrigeration system 22 for forcing a first temperature in the enclosure 21 and a secondary refrigeration system 24 operatively mounted to the *cannabis* feeding system 14 for forcing a second temperature therein.

The casing 20 is formed of four peripheral plexiglass walls 26-32 and a top plexiglass wall 34 that are sealingly assembled in a rectangular shape and sealingly mounted onto the table 12 to form the enclosure 21.

While the casing 20 according to the first illustrated embodiment includes plexiglass walls 26-34, it can be made of another translucid material, such as glass. According to still another embodiment (not shown), part or all the casing is made of another, opaque or not, material.

The casing 20 includes a first opening 36, which defines an inlet for allowing a first passage through the casing 20 for the *cannabis* feeding system 14, and a second opening 38, which defines an outlet for allowing passage through the casing 20 for the products outlet 16 for allowing *cannabis* products (not shown) out of the enclosure 21 after production.

The main refrigeration system 22 comprises a refrigeration unit 40 mounted to the casing 20 on the top wall 34 thereof and air inlet and outlet conduits (both not shown) respectively mounted to the air inlets 42 and outlets 44 of the unit 40. Openings (not shown) are provided in the casing 20 for sealingly receiving the conduits and allow t air circulation between the enclosure 21 and unit 40.

The refrigeration unit further comprises conventional or unconventional sensor(s) and control(s), which allow to set and maintain the temperature to a predetermined value.

Depending on the *cannabis* products (not shown) manufactured by the machine 20, such temperature can be maintained, without limitations, to a value comprised in a range of between about 0° C. and 15° C. More specifically, the temperature in the casing 20 is usually maintained below 5° C.

Furthermore, it has been found that keeping the temperature of the room where the machine 10 is located to about 18° C. improve the operation of the main refrigeration system 22 and more specifically allows the system 22 to reach the desired temperature more easily.

In operation of the machine 10, the main refrigeration system 22 is operated to force the temperature in the enclosure 20, and therefore in and around the processing stations 18 to a predetermined temperature that causes the *cannabis* product being made by the stations 18 to have desired properties consequently to its temperature.

For example, it has been found that a *cannabis*/oil mixture, as mentioned hereinabove, is less sticky at temperature lower than the conventional room temperature range of 18° C. and above, and therefore is easier to use in stations 18.

The expression refrigeration unit should be construed broadly herein as including any system that causes the removing of heat in the air present in the enclosure 21, including any conditioning thereof.

Since refrigeration units are believed to be well known in the art, they will not be described herein in further detail for concision purposes.

With references to FIGS. 1 to 4, a secondary refrigeration system 50, which is adapted to force a temperature within the *cannabis* feeding system 14, will be described.

The *cannabis* feeding system 14 comprises a support frame 52 mounted to a height adjustment mechanism 54, a feeding cone 56 defining an inlet 58 for allowing *cannabis* in bulk in the cone 56 and a narrow outlet 60, and that is mounted to the support frame 52 for rotation about a rotational axis 62, an actuating mechanism 64 secured to the frame 52 and operatively coupled to the feeding cone 56 for selectively causing the rotation thereof about the axis 62, and a cone extension 66 secured to the feeding cone 56 at the inlet thereof 58 so as to be in fluid communication therewith.

According to the illustrated embodiment, the feeding cone 56 and cone extension 66 are both tilted relatively to the horizontal, so that the inlet 67 of the cone extension 66 is higher than the outlet 60 of the feeding cone 56. Both the feeding cone 56 and cone extension 66 together define a *cannabis*-receiving receptacle in the form of a tumbler.

According to the illustrated embodiment, the inner surface of the feeding cone 56 includes a spiral-shaped protrusion thereon (not shown), which contributes to move the bulk infeed product precisely and gradually from the inlet 58 of the feeding cone 56 to the outlet 60 thereof when the tumbler is caused to rotate by the actuating mechanism 64.

The secondary refrigeration system 50 includes an inner cylindrical shell 68 mounted to the frame 52 so as to cover the cone extension 66, a refrigerant coil 70 that is wrapped around the inner shell 68 and an outer cylindrical shell 72, also mounted to the frame 52, and around the cone extension 66 at a distance therefrom so as to define a gap 74 between the inner and outer shells 68 and 72. Together the inner and outer shell 68 and 72 define a cooling sleeve.

According to the first illustrative embodiment, isolation material (not shown) in the form for example of Styrofoam™ or polyurethane foam is provided between the inner and outshell 68 and 72 to limit condensation. According to another illustrative embodiment, such isolation material is omitted.

The secondary refrigeration system 50 further comprises a refrigeration unit 76 mounted to the casing 20 on the top wall 34 thereof. The refrigeration unit 76 is operatively coupled to the refrigerant coil 70 inlet 78 and outlet 80 and is configured to force the circulation of a cooling fluid therein.

The refrigeration unit 76 further comprises conventional or unconventional sensor(s) and control(s) allowing to set and maintain the temperature to a predetermined value around the cone extension 66.

Depending on the *cannabis*/oil mixture, and more specifically on the solidifying temperature of the oil therein, the temperature between the inner and outer shells 68 and 72 can be maintained, without limitations, to a value comprised between about −15° C. and 0° C. At such temperature, the *cannabis*/oil mixture acts as a dry granular material, and, as such, act more fluidly than at room temperature.

In operation of the machine 10, the secondary refrigeration system 50 is operated to force the temperature around and/or in the feeding system to between about −15° C. and −0° C. causing the *cannabis*/oil mixture therein to exhibit fluid-like quality.

Figure 3:
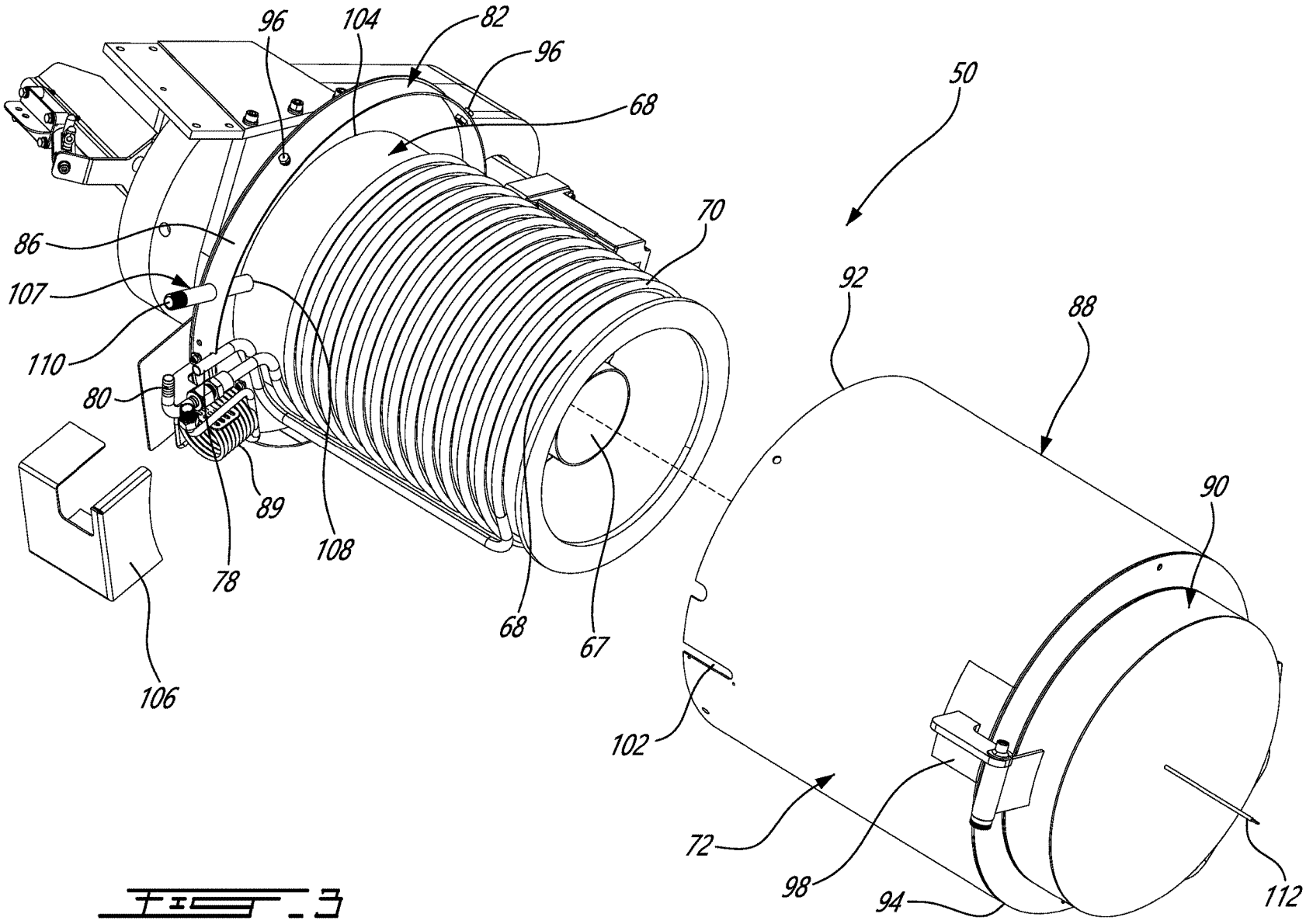
FIG. 3 is an exploded view of the refrigeration subsystem from FIG. 2.
Figure 4:
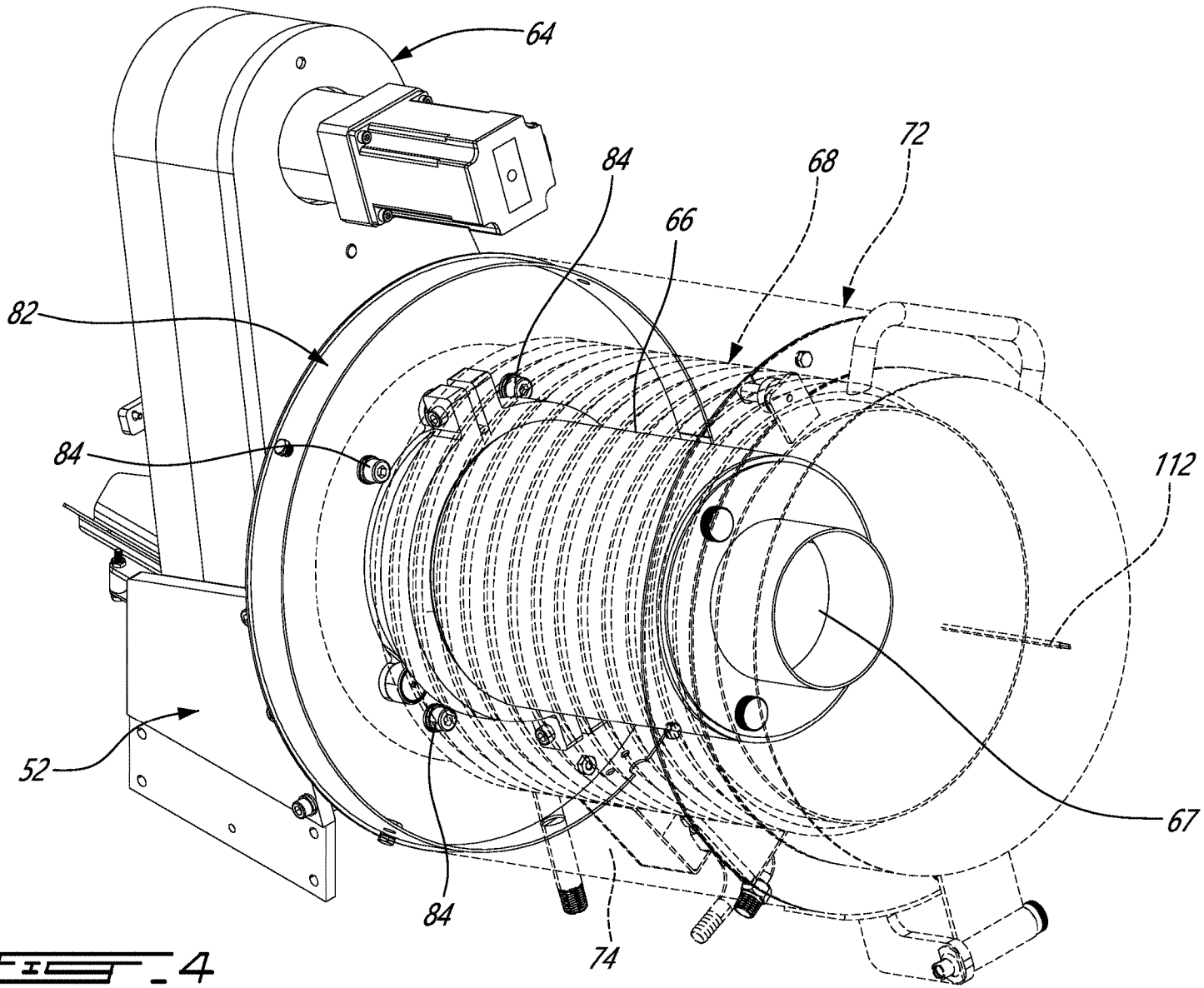
FIG. 4 is an isolated front perspective view of the *cannabis* feeding system shown in FIG. 2, showing part of the refrigeration subsystem in dashed lines.

With reference more specifically to FIGS. 3 and 4, the outer shell 72 includes a mounting plate 82 having a peripheral flange 86, a cylindrical sleeve 88 that is mounted to the plate 82 via its flange 86, and a removable cover 90 mounted to the sleeve 88.

The mounting plate 82 is secured to the mounting frame 52 using fasteners 84. According to another illustrative embodiment (not shown), the mounting plate 82 is secured to the frame 52 using soldering, welding, a mounting collar or bracket (not shown).

The cylindrical sleeve 88 has proximate and distal ends 92 and 94 is removably attached, near its proximate end 92, to the flange 86 using fasteners 96.

The cover 90 is pivotally mounted to the sleeve 88 at the distal end 94 thereof via a pivot mount 98. The cover 90 further includes a handle 100 diametrically opposite the pivot mount 98.

According to another embodiment (not shown), the cover 90 has another configuration then illustrated and/or is removably mounted to the sleeve 88 using another mechanism than a pivot mount 98.

The sleeve 88 is provided with an elongated notch 102 at its proximate end 92 to allow passage for the refrigerant coil 70 inlet 78 and outlet 80.

The inner shell 68 is soldered to the mounting plate 82 at its proximate end 104.

The secondary refrigeration system 50 further includes a protective cap 106 that is secured to the cylindrical sleeve 88 using fasteners or the likes (not shown) and that is configured and sized to cover and protect the refrigerant coil 70 inlet 78 and outlet 80 and the defrost element, which is in the form of a heating coil 89, and that is provided to defrost the outlet 80.

The secondary refrigeration system 50 also includes a small condensation drain tube 107 that is inserted through the flange 86 and that has a distal end 108 near the inner sleeve 68 and a proximate end 110 which extends out of the flange 86.

Finally, the secondary refrigeration system 50 includes a further temperature sensor 112, which is inserted through the cover 90, and which is coupled to the refrigeration unit 76 for determining the temperature near the inlet 67 of the cone extension 66.

The inner and outer shells 68 and 72 and made of metal, or of any heat-conducting material. Furthermore, the tumbler, or any *cannabis*-receiving receptacle is also made of a heat-conducting material, such as, without limitations, acetal, aluminum and stainless steel.

It is to be noted that, while some components and parts of the inner and outer shells 68 and 72 are described as being secured using soldering or fasteners, other attachments can alternatively be used.

The configuration and size of the inner and outer shells 68 and 72 can also be different than illustrated.

Also, the refrigeration method can also be different than a refrigerant coil inserted between two sleeves.

For example, the secondary refrigerant system 50 can be provided with a cooling shell around the *cannabis*-receiving receptacle and include a refrigeration unit with conduits (not shown) to circulate air cooled at a desired temperature between the cooling shell and the *cannabis*-receiving receptacle.

Finally, the secondary refrigeration system 50 can be adapted to another type of *cannabis* feeding device than the illustrated tumbler, such as without limitation a chute or to another type of intrants for the machine 10.

It is to be noted that many modifications could be made to the machine 10 described hereinabove and illustrated in the appended drawings. For example:

- the enclosure 21, including the table 12 and the casing 20, is not limited to being rectangular; and
- the enclosure 21 may include one or more other openings or doors, in addition to the openings 36 and 38, for allowing access to inside the enclosure 21, for maintenance or else;
- while the first and second refrigeration units 40 and 76 are illustrated mounted on top of the casing 20, they can be mounted to other parts of the machine 10 or positioned adjacent thereto;
- in some embodiments, the main or the secondary refrigeration system is omitted.

Although a refrigeration system for a *cannabis* product manufacturing machine, a *cannabis* product manufacturing machine therewith and a process for manufacturing *cannabis* products have been described hereinabove by way of illustrated embodiments thereof, they can be modified. It is therefore to be understood that numerous modifications may be made to the illustrative embodiments and that the scope of the claims should not be limited by the preferred embodiment but should be given the broadest interpretation consistent with the description as a whole.

What is claimed is:

1. A refrigeration system for a *cannabis* product manufacturing machine provided with an intrant feeding system comprising:

- a support configured to receive at least a portion of the *cannabis* product manufacturing machine; and
- a casing mounted to the support and defining, together with the support, an enclosure; the casing having at least one opening configured for allowing access to the intrant feeding system and to *cannabis* products after production;
- wherein, the enclosure having a first temperature lower than 18° C. forced therein.

2. The refrigeration system as recited in claim 1, wherein the enclosure has an inlet for said allowing access to the intrant feeding system and an outlet for allowing the *cannabis* products out of the enclosure.

3. The refrigeration system as recited in claim 2, wherein the inlet is configured to allow at least a portion of the intrant feeding system out of the enclosure.

4. The refrigeration system as recited in claim 1, further comprising a refrigeration subsystem operatively mounted to the intrant feeding system for forcing a second temperature in the intrant feeding system.

5. The refrigeration system as recited in claim 4, wherein the intrant feeding system includes a feeding receptacle; the refrigeration subsystem includes a cooling shell around the feeding receptacle, which has a second temperature forced therein.

6. The refrigeration system as recited in claim 5, wherein the cooling shell includes an inner shell mounted to the feeding receptacle, and outer shell mounted to the inner shell therein so as to define a gap between the inner and outer shell, and refrigerant coil wrapped around the inner shell.

7. The refrigeration system as recited in claim 6, wherein the refrigeration subsystem includes at least one temperature sensor that is operatively coupled the cooling shell.

8. The refrigeration system as recited in claim 5, wherein the feeding receptacle includes a feeding cone, having a narrow side and a wide side and defining an outlet of the feeding receptacle, and a cone extension secured to the feeding cone on the wide side thereof and defining an inlet of the feeding receptacle.

9. The refrigeration system as recited in claim 5, wherein the feeding receptacle includes a removable cover.

10. The refrigeration system as recited in claim 4, wherein the second temperature is within a range between −15° C. and 0° C.

11. The refrigeration system as recited in claim 1, wherein the support includes a table.

12. The refrigeration system as recited in claim 1, wherein the casing is at least partly translucid.

* * * * *